US011649611B2

(12) United States Patent
Kondo et al.

(10) Patent No.: US 11,649,611 B2
(45) Date of Patent: May 16, 2023

(54) HYDRAULIC SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Naoki Hata, Kobe (JP); Hitoshi Nakagawa, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/637,708

(22) PCT Filed: Jul. 31, 2020

(86) PCT No.: PCT/JP2020/029483
§ 371 (c)(1),
(2) Date: Feb. 23, 2022

(87) PCT Pub. No.: WO2021/039287
PCT Pub. Date: Mar. 4, 2021

(65) Prior Publication Data

US 2022/0267997 A1 Aug. 25, 2022

(30) Foreign Application Priority Data

Aug. 23, 2019 (JP) ..... JP2019-152662

(51) Int. Cl.
*E02F 9/22* (2006.01)
*F15B 11/16* (2006.01)

(52) U.S. Cl.
CPC ..... *E02F 9/2292* (2013.01); *E02F 9/2228* (2013.01); *E02F 9/2235* (2013.01); (Continued)

(58) Field of Classification Search
CPC ..... E02F 9/2228; E02F 9/226; E02F 9/2282; E02F 9/2285; F15B 11/166; F15B 2211/355; F15B 2211/575
See application file for complete search history.

(56) References Cited

U.S. PATENT DOCUMENTS 5,701,691 A * 12/1997 Watanabe ..... E02F 3/435 701/50
6,246,939 B1 * 6/2001 Nozawa ..... E02F 3/3411 172/810

(Continued)

FOREIGN PATENT DOCUMENTS

JP 2017-110672 A 6/2017

*Primary Examiner* — Michael Leslie
(74) *Attorney, Agent, or Firm* — Oliff PLC

(57) ABSTRACT

A hydraulic system according to one aspect of the present disclosure includes: control valves interposed between a main pump and hydraulic actuators; and solenoid proportional valves connected to pilot ports of the control valves. Among the solenoid proportional valves, a first solenoid proportional valve and a second solenoid proportional valve are connected to a pair of pilot ports of a particular control valve, respectively. The first solenoid proportional valve and the second solenoid proportional valve are directly connected to an auxiliary pump. The solenoid proportional valves except the first solenoid proportional valve and the second solenoid proportional valve are connected to the auxiliary pump via a switching valve. The switching valve includes a pilot port that is connected, by a switching pilot line, to a first pilot line between the first solenoid proportional valve and the particular control valve.

11 Claims, 7 Drawing Sheets

(52) U.S. Cl.
CPC ..... *E02F 9/2267* (2013.01); *E02F 9/2282* (2013.01); *E02F 9/2285* (2013.01); *E02F 9/2296* (2013.01); *F15B 11/166* (2013.01); *F15B 2211/20576* (2013.01); *F15B 2211/355* (2013.01); *F15B 2211/6316* (2013.01); *F15B 2211/6346* (2013.01)

(56) References Cited

U.S. PATENT DOCUMENTS

| | | | | |
|---|---|---|---|---|
| 8,443,597 | B2 * | 5/2013 | Satake | E02F 9/2228 60/368 |
| 10,227,090 | B2 * | 3/2019 | Kondo | E02F 9/2285 |
| 10,577,777 | B2 * | 3/2020 | Cho | E02F 9/268 |
| 11,105,348 | B2 * | 8/2021 | Kim | E02F 9/2292 |
| 2017/0166253 | A1 | 6/2017 | Kondo | |
| 2020/0032482 | A1 * | 1/2020 | Meguriya | E02F 9/2285 |
| 2022/0282453 | A1 * | 9/2022 | Kondo | E02F 9/2228 |
| 2022/0290408 | A1 * | 9/2022 | Kondo | E02F 9/2292 |
| 2022/0316186 | A1 * | 10/2022 | Kondo | F15B 20/00 |
| 2022/0316187 | A1 * | 10/2022 | Kondo | E02F 9/2285 |
| 2022/0364329 | A1 * | 11/2022 | Kondo | F15B 13/06 |

* cited by examiner

HYDRAULIC SYSTEM OF CONSTRUCTION MACHINE

CROSS-REFERENCE TO RELATED APPLICATIONS

This is a U.S. National Stage Application of International Patent Application No. PCT/JP2020/029483 filed Jul. 31, 2020, which claims priority to Japanese Patent Application No. 2019-152662 filed Aug. 23, 2019. The disclosure of the prior applications is hereby incorporated by reference herein in its entirety.

TECHNICAL FIELD

The present invention relates to a hydraulic system of a construction machine.

BACKGROUND ART

In a hydraulic system installed in construction machines such as hydraulic excavators and hydraulic cranes, control valves are interposed between a main pump and hydraulic actuators. Each of the control valves controls supply and discharge of hydraulic oil to and from a corresponding one of the hydraulic actuators.

Generally speaking, each control valve includes: a spool disposed in a housing; and a pair of pilot ports for moving the spool. In a case where an operation device that outputs an electrical signal is used as an operation device to move the control valve, solenoid proportional valves are connected to the respective pilot ports of the control valve, and the control valve is driven by the solenoid proportional valves.

For example, Patent Literature 1 discloses a configuration for bringing the control valve back to its neutral position when a failure has occurred in the solenoid proportional valves for driving the control valve. In this configuration, a solenoid switching valve is interposed between an auxiliary pump and the solenoid proportional valves for driving the control valve. When a failure has occurred in the solenoid proportional valves for driving the control valve, the solenoid switching valve is switched from an open position to a closed position to stop the supply of the hydraulic oil from the auxiliary pump to the solenoid proportional valves. That is, when a failure has occurred in the solenoid proportional valves for driving the control valve, even if an operator operates the operation device, the control valve is kept in the neutral position and the operation performed on the operation device is invalidated.

CITATION LIST

Patent Literature

PTL 1: Japanese Laid-Open Patent Application Publication No. 2017-110672

SUMMARY OF INVENTION

Technical Problem

However, the configuration disclosed in Patent Literature 1 requires a solenoid valve that is dedicated for invalidating an operation performed on the operation device.

In view of the above, an object of the present invention is to provide a hydraulic system of a construction machine, the hydraulic system making it possible to invalidate operations performed on operation devices without using a solenoid valve that is dedicated for invalidating operations performed on the operation devices.

Solution to Problem

In order to solve the above-described problems, the inventors of the present invention have come up with an idea that by separating solenoid proportional valves that are intended for driving control valves into those directly connected to the auxiliary pump, i.e., the solenoid proportional valves that are always movable ("always-movable solenoid proportional valves"), and those connected to the auxiliary pump via the switching valve, i.e., the solenoid proportional valves whose movability is switchable between movable and non-movable ("movability-switchable solenoid proportional valves"), it may be possible to use an always-movable solenoid proportional valve to invalidate operations performed on operation devices. The present invention has been made from such a technological point of view.

Specifically, a hydraulic system of a construction machine according to the present invention includes: control valves interposed between a main pump and hydraulic actuators, each control valve including a pair of pilot ports; solenoid proportional valves connected to the pair of pilot ports of the control valves; operation devices to move the control valves, each operation device outputting an electrical signal corresponding to an operating amount of the operation device; and a controller that controls the solenoid proportional valves based on the electrical signals outputted from the operation devices. The control valves include a particular control valve, and the solenoid proportional valves include a first solenoid proportional valve and a second solenoid proportional valve that are connected to the pair of pilot ports of the particular control valve by a first pilot line and a second pilot line, respectively. The first solenoid proportional valve and the second solenoid proportional valve are directly connected to an auxiliary pump. The solenoid proportional valves except the first solenoid proportional valve and the second solenoid proportional valve are connected to the auxiliary pump via a switching valve. The switching valve includes a pilot port that is connected to the first pilot line by a switching pilot line, and switches between a closed position and an open position in accordance with a pilot pressure led to the pilot port of the switching valve.

According to the above configuration, whether to switch the switching valve, which is interposed between the auxiliary pump and the solenoid proportional valves except the first solenoid proportional valve and the second solenoid proportional valve, to the closed position or to the open position, i.e., whether to invalidate or validate operations performed on the operation devices except a particular operation device that is an operation device to move the particular control valve, can be switched based on the secondary pressure of the first solenoid proportional valve. That is, the switching valve can be operated by using the first solenoid proportional valve, which is intended for driving the particular control valve. Therefore, a solenoid valve dedicated for invalidating operations performed on the operation devices except the particular operation device is unnecessary.

Advantageous Effects of Invention

The present invention makes it possible to invalidate operations performed on operation devices without using a solenoid valve that is dedicated for invalidating operations performed on the operation devices.

DESCRIPTION OF EMBODIMENTS

Embodiment 1

Figure 1:
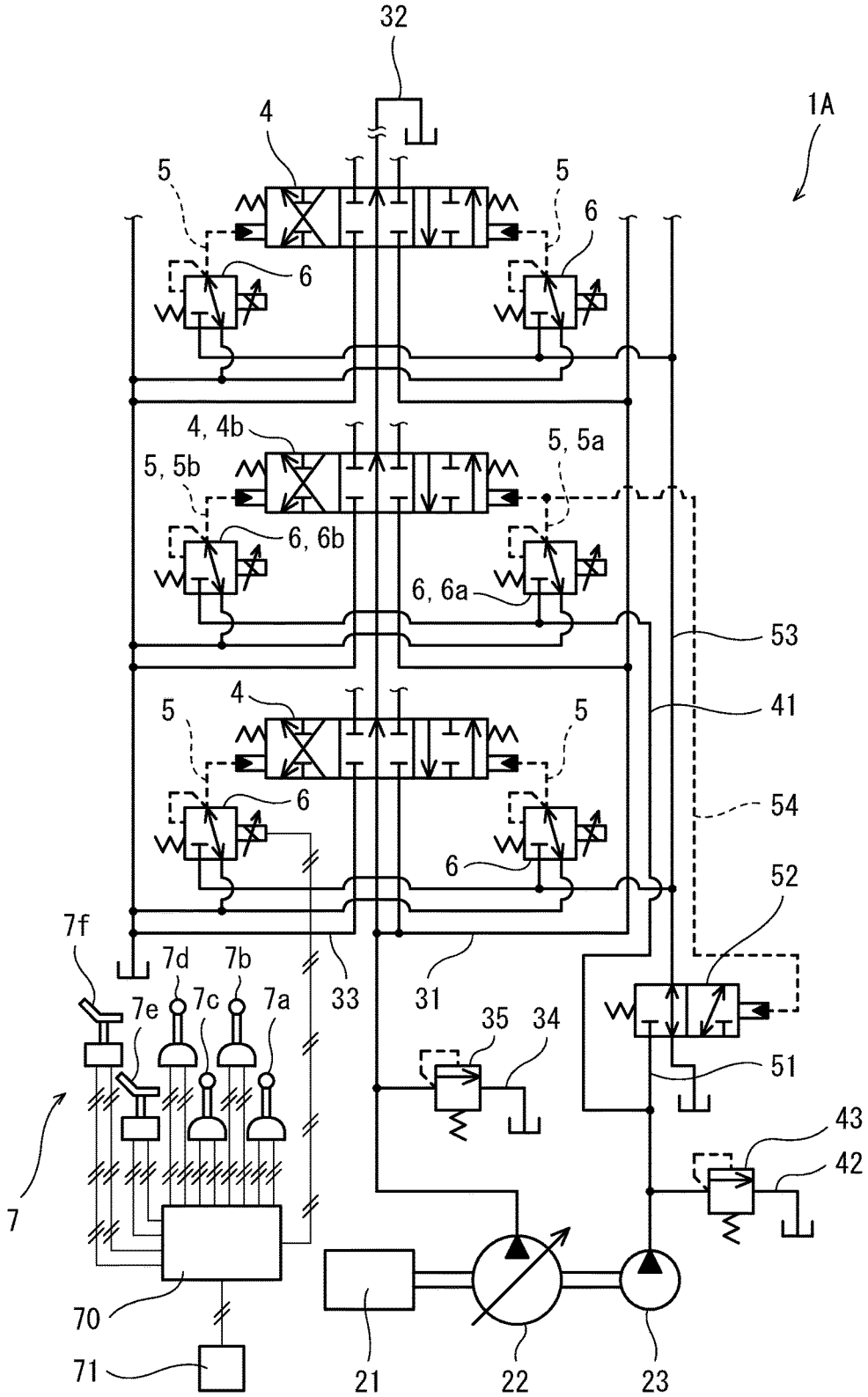
FIG. 1 shows a schematic configuration of a hydraulic system of a construction machine according to Embodiment 1 of the present invention.
Figure 2:
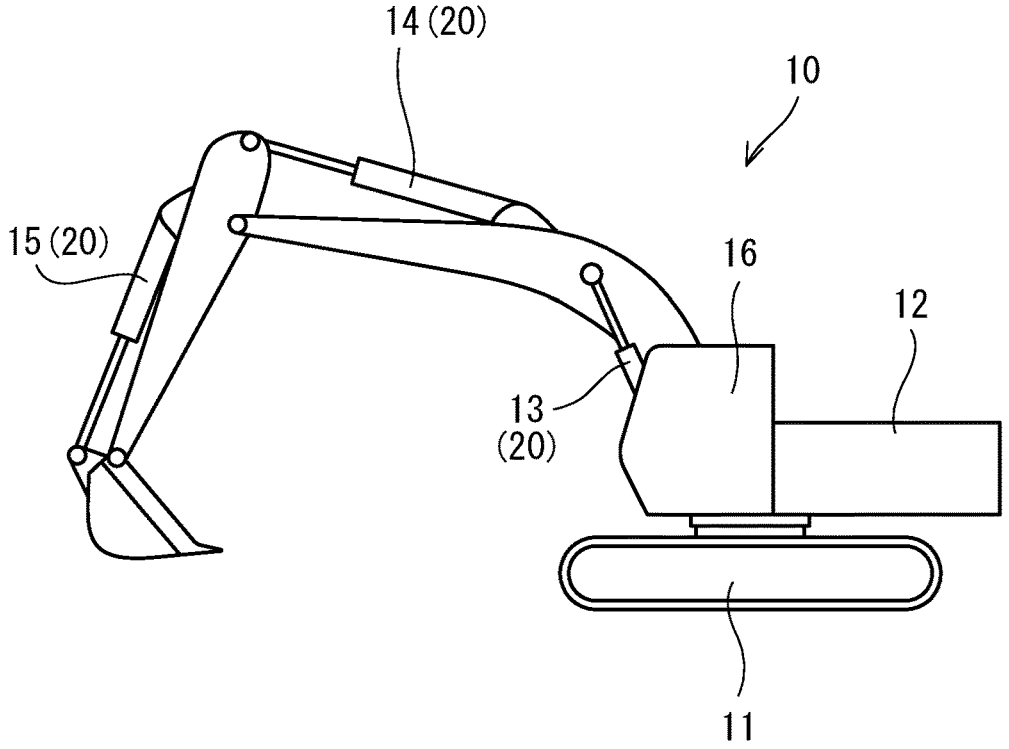
FIG. 2 is a side view of a hydraulic excavator, which is one example of the construction machine.

FIG. 1 shows a hydraulic system 1A of a construction machine according to Embodiment 1 of the present invention. FIG. 2 shows a construction machine 10, in which the hydraulic system 1A is installed. Although the construction machine 10 shown in FIG. 2 is a hydraulic excavator, the present invention is applicable to other construction machines, such as a hydraulic crane.

The construction machine 10 shown in FIG. 2 is a self-propelled construction machine, and includes a traveling unit 11. The construction machine 10 further includes: a slewing unit 12 slewably supported by the traveling unit 11; and a boom that is luffed relative to the slewing unit 12. An arm is swingably coupled to the distal end of the boom, and a bucket is swingably coupled to the distal end of the arm. The slewing unit 12 is equipped with a cabin 16 including an operator's seat. In the present embodiment, the traveling unit 11 includes crawlers as traveling means. Alternatively, the traveling means of the traveling unit 11 may be wheels. The construction machine 10 need not be of a self-propelled type.

The hydraulic system 1A includes, as hydraulic actuators 20, a boom cylinder 13, an arm cylinder 14, and a bucket cylinder 15, which are shown in FIG. 2, and an unshown slewing motor and a pair of unshown travel motors (a left travel motor and a right travel motor). The boom cylinder 13 luffs the boom. The arm cylinder 14 swings the arm. The bucket cylinder 15 swings the bucket. The slewing motor slews the slewing unit 12. The left travel motor rotates the left crawler of the traveling unit 11, and the right travel motor rotates the right crawler of the traveling unit 11.

As shown in FIG. 1, the hydraulic system 1A further includes a main pump 22, which supplies hydraulic oil to the aforementioned hydraulic actuators 20. In FIG. 1, the hydraulic actuators 20 are not shown for the purpose of simplifying the drawing.

The main pump 22 is driven by an engine 21. Alternatively, the main pump 22 may be driven by an electric motor. The engine 21 also drives an auxiliary pump 23. The number of main pumps 22 may be more than one.

The main pump 22 is a variable displacement pump (a swash plate pump or a bent axis pump) whose tilting angle is changeable. The delivery flow rate of the main pump 22 may be controlled by electrical positive control, or may be controlled by hydraulic negative control. Alternatively, the delivery flow rate of the main pump 22 may be controlled by load-sensing control.

Control valves 4 are interposed between the main pump 22 and the hydraulic actuators 20. In the present embodiment, all the control valves 4 are three-position valves. Alternatively, one or more of the control valves 4 may be two-position valves.

All the control valves 4 are connected to the main pump 22 by a supply line 31, and connected to the tank by a tank line 33. Each of the control valves 4 is connected to a corresponding one of the hydraulic actuators 20 by a pair of supply/discharge lines. In a case where the number of main pumps 22 is more than one, the same number of groups of the control valves 4 as the number of main pumps 22 are formed. In each group, the control valves 4 are connected to the corresponding main pump 22 by the supply line 31.

For example, the control valves 4 include: a boom control valve that controls supply and discharge of the hydraulic oil to and from the boom cylinder 13; an arm control valve that controls supply and discharge of the hydraulic oil to and from the arm cylinder 14; and a bucket control valve 4*b*, which controls supply and discharge of the hydraulic oil to and from the bucket cylinder 15. The control valves 4 also include a slewing control valve that controls supply and discharge of the hydraulic oil to and from the slewing motor.

The aforementioned supply line 31 includes a main passage and branch passages. The main passage extends from the main pump 22. The branch passages are branched off from the main passage and connect to the control valves 4. In the present embodiment, a center bypass line 32 is branched from the main passage of the supply line 31, and the center bypass line 32 extends to the tank. The control valves 4 are disposed on the center bypass line 32. The center bypass line 32 may be eliminated.

A relief line 34 is branched off from the main passage of the supply line 31, and the relief line 34 is provided with a relief valve 35 for the main pump 22. The relief line 34 may be branched off from the center bypass line 32 at a position upstream of all the control valves 4.

Each control valve 4 includes: a spool disposed in a housing; and a pair of pilot ports for moving the spool. For example, the housings of all the control valves 4 may be integrated together to form a multi-control valve unit. The pilot ports of each control valve 4 are connected to respective solenoid proportional valves 6 by respective pilot lines 5.

Each solenoid proportional valve 6 is a direct proportional valve that outputs a secondary pressure indicating a positive correlation with a command current. Alternatively, each solenoid proportional valve 6 may be an inverse proportional valve that outputs a secondary pressure indicating a negative correlation with the command current.

In the present embodiment, the bucket control valve 4*b* corresponds to a particular control valve of the present invention. As the aforementioned pair of pilot ports, the bucket control valve 4*b* includes a first pilot port for a first bucket operation and a second pilot port for a second bucket operation.

The solenoid proportional valves 6 include a first solenoid proportional valve 6*a* and a second solenoid proportional valve 6*b*. The first solenoid proportional valve 6*a* is connected to the first pilot port of the bucket control valve 4*b* by a first pilot line 5*a*, and the second solenoid proportional valve 6*b* is connected to the second pilot port of the bucket control valve 4*b* by a second pilot line 5*b*.

The first solenoid proportional valve 6*a* and the second solenoid proportional valve 6*b* are directly connected to the auxiliary pump 23, and the solenoid proportional valves 6 except the first solenoid proportional valve 6*a* and the second solenoid proportional valve 6*b* are connected to the auxiliary pump 23 via a switching valve 52. That is, the first solenoid proportional valve 6*a* and the second solenoid proportional valve 6*b* are solenoid proportional valves that are always movable, whereas the solenoid proportional valves 6 except the first solenoid proportional valve 6*a* the second solenoid proportional valve 6*b* are solenoid proportional valves whose movability is switchable between movable and non-movable.

Specifically, the first solenoid proportional valve 6*a* and the second solenoid proportional valve 6*b* are connected to the auxiliary pump 23 by a primary pressure line 41. The primary pressure line 41 includes a main passage and two branch passages. The main passage extends from the auxiliary pump 23. The two branch passages are branched off from the main passage and connect to the first solenoid proportional valve 6*a* and the second solenoid proportional valve 6*b*. A relief line 42 is branched off from the main passage of the primary pressure line 41, and the relief line 42 is provided with a relief valve 43 for the auxiliary pump 23.

On the other hand, the solenoid proportional valves 6 except the first solenoid proportional valve 6*a* and the second solenoid proportional valve 6*b* are connected to the switching valve 52 by a downstream-side primary pressure line 53, and the switching valve 52 is connected to the auxiliary pump 23 by an upstream-side primary pressure line 51. The downstream-side primary pressure line 53 includes a main passage and branch passages. The main passage extends from the switching valve 52. The branch passages are branched off from the main passage and connect to the solenoid proportional valves 6. The upstream portion of the upstream-side primary pressure line 51 and the upstream portion of the aforementioned primary pressure line 41 merge together to form a shared passage.

The switching valve 52 includes a pilot port, and switches between a closed position and an open position in accordance with a pilot pressure led to the pilot port. In the present embodiment, the closed position is the neutral position of the switching valve 52. That is, when the pilot pressure becomes higher than or equal to a setting value α, the switching valve 52 switches from the closed position to the open position. The pilot port of the switching valve 52 is connected to the aforementioned first pilot line 5*a* by a switching pilot line 54.

When the switching valve 52 is in the closed position, the switching valve 52 blocks the upstream-side primary pressure line 51, and brings the downstream-side primary pressure line 53 into communication with the tank. When the switching valve 52 is in the open position, the switching valve 52 brings the upstream-side primary pressure line 51 into communication with the downstream-side primary pressure line 53. In other words, in a state where the switching valve 52 is kept in the closed position, the supply of the hydraulic oil from the auxiliary pump 23 to the solenoid proportional valves 6 except the first solenoid proportional valve 6*a* and the second solenoid proportional valve 6*b* (i.e., to the movability-switchable solenoid proportional valves 6) is stopped, and the primary pressure of each movability-switchable solenoid proportional valve 6 is zero. Accordingly, even when electric currents are fed to the movability-switchable solenoid proportional valves 6, the corresponding control valves 4 do not move.

Operation devices 7 to move the control valves 4 are disposed in the aforementioned cabin 16. Each operation device 7 includes an operating unit (an operating lever or a foot pedal) that receives an operation for moving a corresponding one of the hydraulic actuators 20, and outputs an electrical signal corresponding to an operating amount (e.g., an inclination angle of the operating lever) of the operating unit.

Specifically, the operation devices 7 include: a boom operation device 7*a*, an arm operation device 7*b*, a bucket operation device 7*c*, and a slewing operation device 7*d*, each of which includes an operating lever; and a left travel operation device 7*e* and a right travel operation device 7*f*, each of which includes a foot pedal. Some of the operation devices 7 may be combined together and may share the same operating lever. For example, the boom operation device 7*a* and the bucket operation device 7*c* may be combined together, and the arm operation device 7*b* and the slewing operation device 7*d* may be combined together. In the present embodiment, the bucket operation device 7*c* corresponds to a particular operation device of the present invention.

The operating lever of the boom operation device 7*a* receives a boom raising operation and a boom lowering operation. The operating lever of the arm operation device 7*b* receives an arm crowding operation and an arm pushing operation. The operating lever of the bucket operation device 7*c* receives a first bucket operation and a second bucket operation. The operating lever of the slewing operation device 7*d* receives a left slewing operation and a right slewing operation. Each of the foot pedal of the left travel operation device 7*e* and the foot pedal of the right travel operation device 7*f* receives a forward travel operation and a backward travel operation.

One of the first and second bucket operations is a bucket excavating operation, and the other is a bucket dumping operation. The bucket excavating operation may be either the first bucket operation or the second bucket operation. When the operating lever of the bucket operation device 7*c* receives the first bucket operation (i.e., when the operating lever is inclined in a first bucket operation direction), the bucket operation device 7*c* outputs a first bucket electrical signal whose magnitude corresponds to the operating amount of the operating lever (i.e., the inclination angle of the operating lever). When the operating lever receives the second bucket operation (i.e., when the operating lever is inclined in a second bucket operation direction), the bucket operation device 7*c* outputs a second bucket electrical signal whose magnitude corresponds to the operating amount of the operating lever (i.e., the inclination angle of the operating lever).

The electrical signal outputted from each operation device 7 is inputted to a controller 70. The controller 70 controls the solenoid proportional valves 6 based on the electrical signals outputted from the operation devices 7. FIG. 1 shows only part of signal lines for simplifying the drawing. For example, the controller 70 is a computer including memories such as a ROM and RAM, a storage such as a HDD, and a CPU. The CPU executes a program stored in the ROM or HDD.

For example, when the first bucket electrical signal is outputted from the bucket operation device 7*c*, the controller 70 feeds a command current to the first solenoid proportional valve 6*a*, and increases the command current in accordance with increase in the first bucket electrical signal. Similarly, when the second bucket electrical signal is outputted from the bucket operation device 7*c*, the controller 70 feeds a command current to the second solenoid proportional valve 6*b*, and increases the command current in accordance with increase in the second bucket electrical signal.

A selector 71 is disposed in the cabin 16. With the selector 71, an operator selects whether to invalidate or validate operations performed on the operation devices 7 except the bucket operation device 7*c*. The selector 71 receives a selection of operation lock, which is a selection to invalidate operations performed on the operation devices 7 except the bucket operation device 7*c*, or receives a selection of operation lock release, which is a selection to validate operations performed on the operation devices 7 except the bucket operation device 7*c*.

For example, the selector 71 may be a micro switch or limit switch including a safety lever, and by shifting or swinging the safety lever, the selection of operation lock or the selection of operation lock release can be made. Alternatively, the selector 71 may be a push button switch including a button, and by pushing or not pushing the button, the selection of operation lock or the selection of operation lock release can be made.

Figure 3:
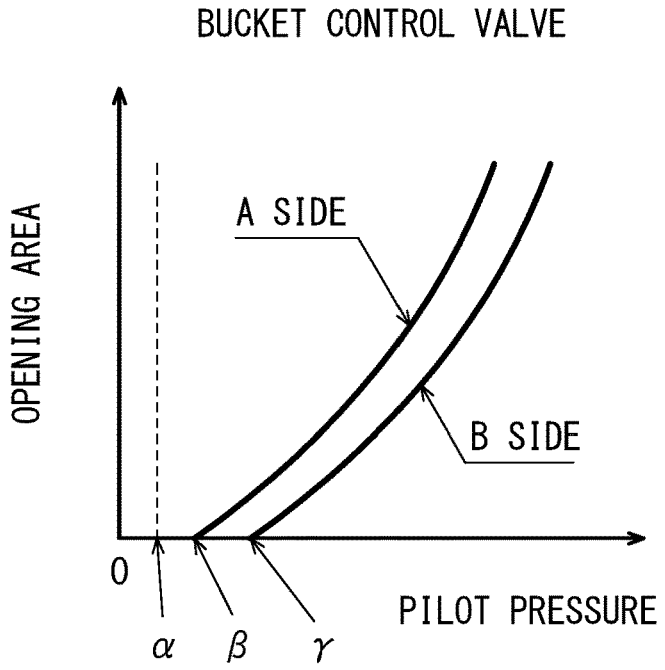
FIG. 3 is a graph showing a relationship between a pilot pressure to a bucket control valve and the opening area of the bucket control valve.
Figure 4:
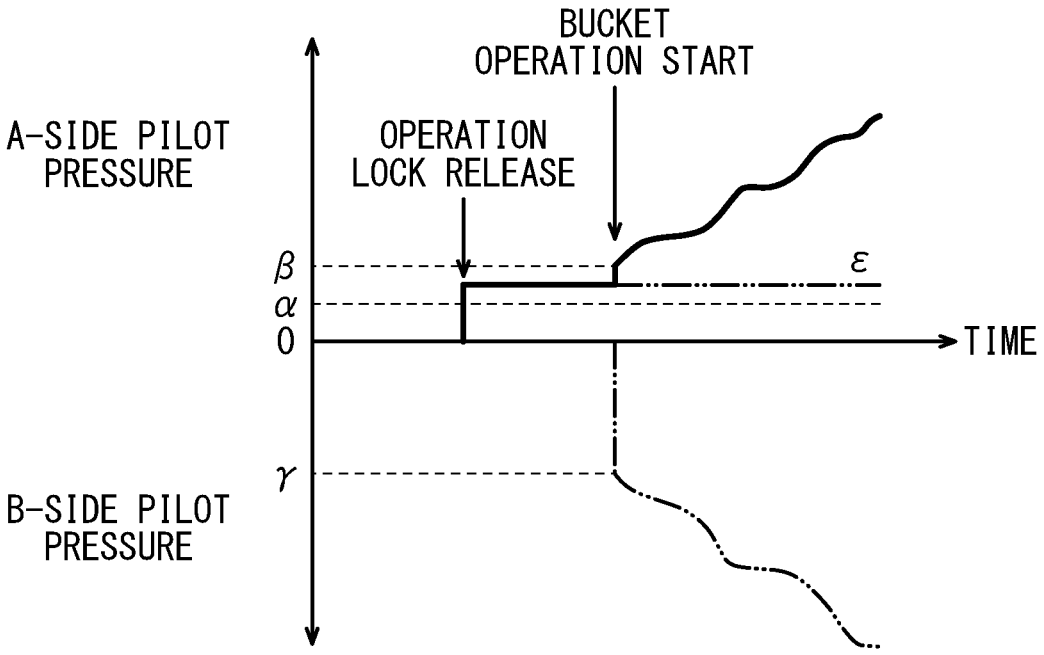
FIG. 4 is a graph showing temporal changes in pilot pressures outputted from a first solenoid proportional valve and a second solenoid proportional valve when a bucket operation is performed.

Next, the control of the first solenoid proportional valve 6*a* and the second solenoid proportional valve 6*b* by the controller 70 is described in detail with reference to FIG. 3 and FIG. 4. In FIG. 3 and FIG. 4, the first pilot port side of the bucket control valve 4*b* is referred to as "A side" and the second pilot port side of the bucket control valve 4*b* is referred to as "B side."

While the selector 71 is receiving the selection of operation lock, the controller 70 controls the first solenoid proportional valve 6*a*, such that the secondary pressure of the first solenoid proportional valve 6*a* is lower than the setting value $\alpha$ of the switching valve 52 as shown in FIG. 4. As a result, the switching valve 52 is kept in the closed position. At the time, the controller 70 may feed no command current to the first solenoid proportional valve 6*a*, or may feed a command current lower than the electric current value corresponding to the setting value $\alpha$ to the first solenoid proportional valve 6*a*.

On the other hand, while the selector 71 is receiving the selection of operation lock release, the controller 70 controls the first solenoid proportional valve 6*a*, such that the secondary pressure of the first solenoid proportional valve 6*a* is higher than the setting value $\alpha$ of the switching valve 52. As a result, the switching valve 52 is switched to the open position, and thereby operations different from the bucket operations are also enabled.

To be more specific, during the selector 71 receiving the selection of operation lock release, when the first bucket operation is not performed (i.e., when the first bucket electrical signal is not outputted from the bucket operation device 7*c*), the controller 70 feeds a standby current to the first solenoid proportional valve 6*a* as a command current to keep the secondary pressure of the first solenoid proportional valve 6*a* to a predetermined value $\varepsilon$, which is higher than the setting value $\alpha$ of the switching valve 52.

As shown in FIG. 3, in a case where the pilot pressure at one of the first and second pilot ports of the bucket control valve 4*b* is zero, when the pilot pressure at the other one of the first and second pilot ports becomes a predetermined value $\beta$, the bucket control valve 4*b* starts opening (i.e., one of or both supply/discharge passages start communicating with a pump passage). The predetermined value $\beta$ is higher than the setting value $\alpha$ of the switching valve 52. The aforementioned predetermined value $\varepsilon$ is lower than the predetermined value $\beta$.

On the other hand, during the selector 71 receiving the selection of operation lock release, when the first bucket operation is performed (i.e., when the first bucket electrical signal is outputted from the bucket operation device 7*c*), at the start of the bucket operation, the controller 70 feeds a command current to the first solenoid proportional valve 6*a*, such that the secondary pressure of the first solenoid proportional valve 6*a* increases from the predetermined value $\varepsilon$ to the predetermined value $\beta$ as indicated by solid line in FIG. 4. Thereafter, the controller 70 feeds a command current whose magnitude corresponds to the first bucket electrical signal to the first solenoid proportional valve 6*a* as previously described.

Regardless of whether the selector 71 is receiving the selection of operation lock or receiving the selection of operation lock release, the controller 70 feeds no command current to the second solenoid proportional valve 6*b* unless the second bucket operation is performed (i.e., unless the second bucket electrical signal is outputted from the bucket operation device 7*c*).

During the selector 71 receiving the selection of operation lock release, when the second bucket operation is performed (i.e., when the second bucket electrical signal is outputted from the bucket operation device 7*c*), since the pressure at the first pilot port of the bucket control valve 4*b* is the predetermined value $\varepsilon$, the bucket control valve 4*b* does not open until the pressure at the second pilot port becomes a predetermined value $\gamma$ ($=\beta+\varepsilon$). Accordingly, at the start of the bucket operation, the controller 70 feeds a command current to the second solenoid proportional valve 6*b*, such that the secondary pressure of the second solenoid proportional valve 6*b* increases to the predetermined value $\gamma$ as indicated by two-dot chain line in FIG. 4. Thereafter, the controller 70 feeds a command current whose magnitude corresponds to the second bucket electrical signal to the second solenoid proportional valve 6*b* as previously described.

As described above, in the hydraulic system 1A of the present embodiment, whether to switch the switching valve 52, which is interposed between the auxiliary pump 23 and the solenoid proportional valves 6 except the first solenoid proportional valve 6*a* and the second solenoid proportional valve 6*b*, to the closed position or to the open position, i.e., whether to invalidate or validate operations performed on the operation devices 7 except the bucket operation device 7*c*, can be switched based on the secondary pressure of the first solenoid proportional valve 6*a*. That is, the switching valve 52 can be operated by using the first solenoid proportional valve 6*a*, which is intended for driving the bucket control valve 4*b*. Therefore, a solenoid valve dedicated for invalidating operations performed on the operation devices 7 except the bucket operation device 7*c* is unnecessary.

Since the present embodiment includes the selector 71, when the operator makes the selection of operation lock with the selector 71, operations performed on the operation devices 7 except the bucket operation device 7*c* are invalidated, whereas when the operator makes the selection of operation lock release with the selector 71, operations performed on the operation devices 7 except the bucket operation device 7*c* are validated.

<Variations>

In the above-described embodiment, the secondary pressure of the second solenoid proportional valve 6*b* is zero unless the second bucket operation is performed. Alternatively, the second solenoid proportional valve 6*b* may be controlled in the same manner as the first solenoid proportional valve 6*a*. That is, while the selector 71 is receiving the selection of operation lock, the controller 70 may control the second solenoid proportional valve 6*b*, such that the secondary pressure of the second solenoid proportional valve 6*b* is lower than the setting value α of the switching valve 52, and while the selector 71 is receiving the selection of operation lock release, the controller 70 may control the second solenoid proportional valve 6*b*, such that the secondary pressure of the second solenoid proportional valve 6*b* is higher than the setting value α of the switching valve 52.

Figure 5:
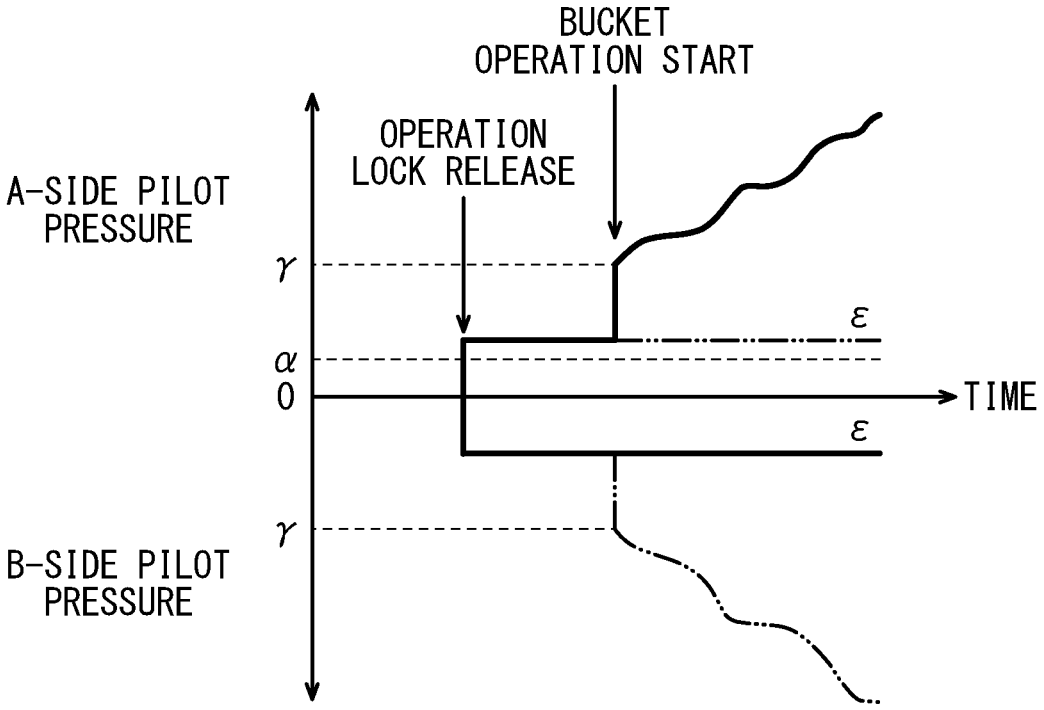
FIG. 5 is a graph showing temporal changes in pilot pressures outputted from the first solenoid proportional valve and the second solenoid proportional valve in the hydraulic system according to a variation of Embodiment 1 when a bucket operation is performed.
Figure 6:
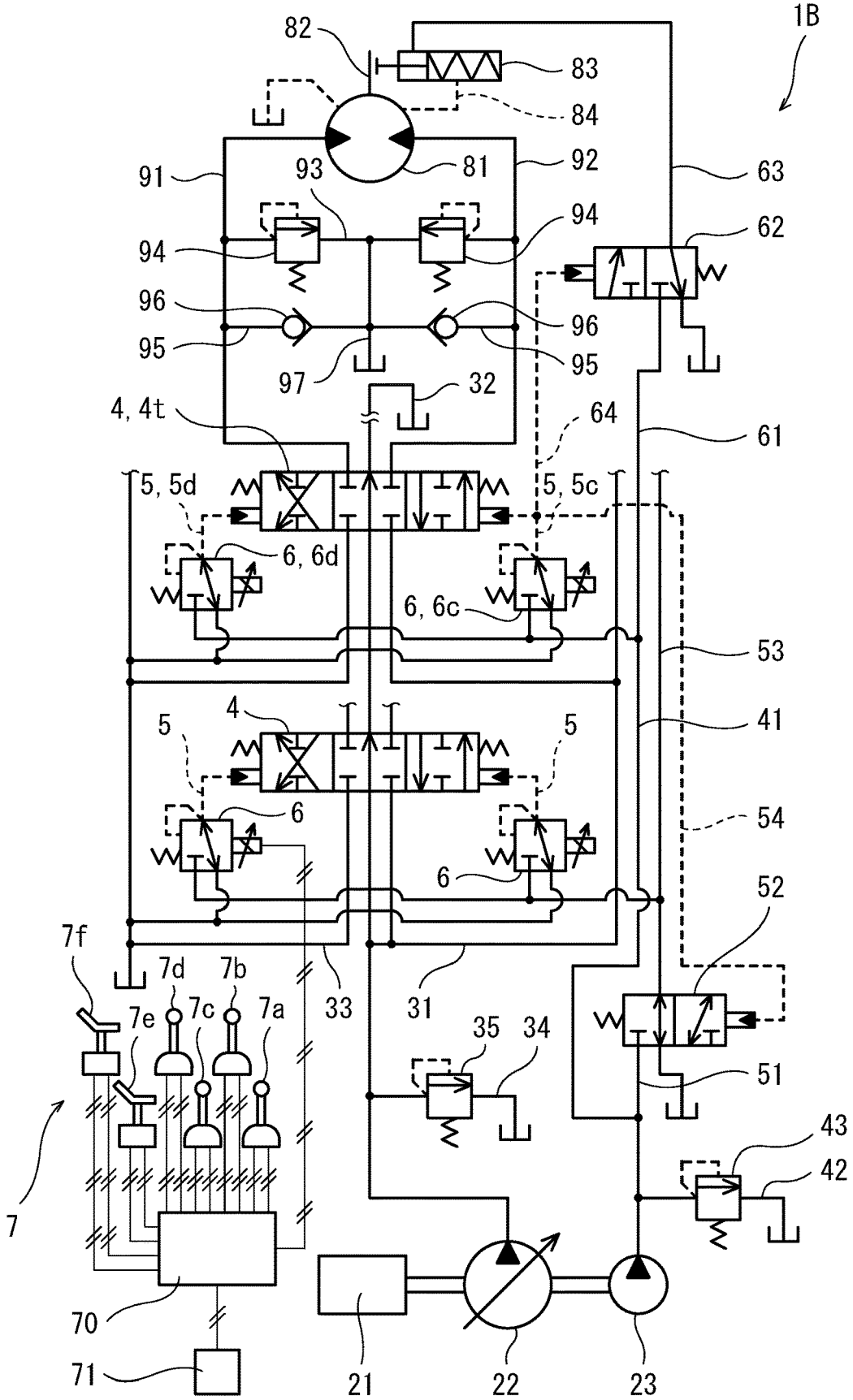
FIG. 6 shows a schematic configuration of a hydraulic system of a construction machine according to Embodiment 2 of the present invention.

For example, as shown in FIG. 5, during the selector 71 receiving the selection of operation lock release, when neither the first bucket operation nor the second bucket operation is performed, the controller 70 feeds a standby current as a command current to each of the first solenoid proportional valve 6*a* and the second solenoid proportional valve 6*b* to keep the secondary pressure of each of the first solenoid proportional valve 6*a* and the second solenoid proportional valve 6*b* to the predetermined value ε, which is higher than the setting value α of the switching valve 52. At the time, the predetermined value ε need not be lower than the aforementioned predetermined value β (the predetermined value β is, in a case where the pilot pressure at one of the first and second pilot ports of the bucket control valve 4*b* is zero, the pilot pressure at the other one of the first and second pilot ports when the bucket control valve 4*b* starts opening). However, it is desirable that the predetermined value ε be lower than the predetermined value β.

On the other hand, during the selector 71 receiving the selection of operation lock release, when the first bucket operation or the second bucket operation is performed, at the start of the bucket operation, the controller 70 feeds a command current to the first solenoid proportional valve 6*a* or the second solenoid proportional valve 6*b*, such that the secondary pressure of the first solenoid proportional valve 6*a* or the second solenoid proportional valve 6*b* increases from the predetermined value ε to the predetermined value γ (=β+ε) as indicated by solid line or two-dot chain line in FIG. 5.

While the selector 71 is receiving the selection of operation lock release, the secondary pressure of the second solenoid proportional valve 6*b* may be zero as in the above-described embodiment. In this case, however, the pressure difference between the pilot pressure for switching the switching valve 52 (i.e., the predetermined value ε in FIG. 4) and the pilot pressure when the bucket control valve 4*b* starts opening (i.e., the predetermined value β in FIG. 4) is small. Therefore, it is desirable to take malfunction preventative measures, such as strengthening a return spring in the bucket control valve 4*b*. In this respect, while the selector 71 is receiving the selection of operation lock release, if the second solenoid proportional valve 6*b* also outputs a secondary pressure higher than or equal to the setting value α of the switching valve 52 as in the present variation, the pressure difference between the pilot pressure for switching the switching valve 52 (i.e., the predetermined value ε in FIG. 5) and the pilot pressure when the bucket control valve 4*b* starts opening (i.e., the predetermined value γ in FIG. 5) becomes great. Therefore, taking malfunction preventative measures is unnecessary.

Embodiment 2

Next, a hydraulic system 1B of a construction machine according to Embodiment 2 of the present invention is described with reference to FIG. 6 to FIG. 9. In the present embodiment, the same components as those described in Embodiment 1 are denoted by the same reference signs as those used in Embodiment 1, and repeating the same descriptions is avoided.

In the present embodiment, the slewing control valve 4*t* corresponds to the particular control valve of the present invention, and the slewing operation device 7*d* corresponds to the particular operation device of the present invention. The present embodiment includes, as a first switching valve, the switching valve 52 described in Embodiment 1. A second switching valve 62 is also adopted in the present embodiment.

The operating lever of the slewing operation device 7*d* receives a first slewing operation and a second slewing operation. One of the first and second slewing operations is a left slewing operation, and the other is a right slewing operation. The left slewing operation may be either the first slewing operation or the second slewing operation. When the operating lever of the slewing operation device 7*d* receives the first slewing operation (i.e., when the operating lever is inclined in a first slewing direction), the slewing operation device 7*d* outputs a first slewing electrical signal whose magnitude corresponds to the operating amount of the operating lever (i.e., the inclination angle of the operating lever). When the operating lever receives the second slewing operation (i.e., when the operating lever is inclined in a second slewing direction), the slewing operation device 7*d* outputs a second slewing electrical signal whose magnitude corresponds to the operating amount of the operating lever (i.e., the inclination angle of the operating lever).

As the aforementioned pair of pilot ports, the slewing control valve 4*t* includes a first pilot port for the first slewing operation and a second pilot port for the second slewing operation. The solenoid proportional valves 6 include a first solenoid proportional valve 6*c* and a second solenoid proportional valve 6*d*. The first solenoid proportional valve 6*c* is connected to the first pilot port of the slewing control valve 4*t* by a first pilot line 5*c*, and the second solenoid proportional valve 6*d* is connected to the second pilot port of the slewing control valve 4*t* by a second pilot line 5*d*.

When the first slewing electrical signal is outputted from the slewing operation device 7*d*, the controller 70 feeds a command current to the first solenoid proportional valve 6*c*, and increases the command current in accordance with increase in the first slewing electrical signal. Similarly, when the second slewing electrical signal is outputted from the slewing operation device 7*d*, the controller 70 feeds a command current to the second solenoid proportional valve 6*d*, and increases the command current in accordance with increase in the second slewing electrical signal.

Similar to the first solenoid proportional valve 6*a* and the second solenoid proportional valve 6*b* of Embodiment 1, the first solenoid proportional valve 6*c* and the second solenoid proportional valve 6*d* are directly connected to the auxiliary pump 23. On the other hand, the solenoid proportional valves 6 except the first solenoid proportional valve 6*c* and the second solenoid proportional valve 6*d* (i.e., the solenoid proportional valves 6 including those intended for driving the bucket control valve 4*b*) are connected to the auxiliary pump 23 via the first switching valve 52. That is, the first solenoid proportional valve 6*c* and the second solenoid proportional valve 6*d* are solenoid proportional valves that are always movable, whereas the solenoid proportional valves 6 except the first solenoid proportional valve 6*c* and the second solenoid proportional valve 6*d* are solenoid proportional valves whose movability is switchable between movable and non-movable.

The slewing control valve 4*t* is connected to a slewing motor 81 by a pair of supply/discharge lines 91 and 92. The supply/discharge lines 91 and 92 are connected to each other by a bridging passage 93. The bridging passage 93 is provided with a pair of relief valves 94, which are directed opposite to each other. A portion of the bridging passage 93 between the relief valves 94 is connected to the tank by a make-up line 97. Each of the supply/discharge lines 91 and 92 is connected to the make-up line 97 by a corresponding one of bypass lines 95. Alternatively, the pair of bypass lines 95 may be provided on the bridging passage 93 in a manner to bypass the pair of relief valves 94, respectively. The bypass lines 95 are provided with check valves 96, respectively.

The slewing motor 81 is provided with a mechanical brake 83 to prevent the slewing unit 12 from slewing, for example, when the construction machine is parked on a slope. The mechanical brake 83 has a structure in which a spring thereof blocks an output shaft 82 of the slewing motor 81 from rotating. To release the blocking by the spring, hydraulic pressure is used. Specifically, when supplied with pressurized oil, the mechanical brake 83 is switched from a brake-applied state, in which the mechanical brake 83 prevents the rotation of the output shaft 82 of the slewing motor 81, to a brake-released state, in which the mechanical brake 83 allows the rotation of the output shaft 82. A drain line 84 extends from the mechanical brake 83 to the tank through the slewing motor 81.

The mechanical brake 83 is connected to the second switching valve 62 by a supply/discharge line 63. The second switching valve 62 is connected to the auxiliary pump 23 by a pump line 61. The upstream portion of the pump line 61 and the upstream portion of the primary pressure line 41 described in Embodiment 1 merge together to form a shared passage.

The second switching valve 62 interposed between the auxiliary pump 23 and the mechanical brake 83 includes a pilot port, and switches from a closed position, i.e., a neutral position, to an open position when a pilot pressure led to the pilot port becomes higher than or equal to a setting value $\alpha'$ (corresponding to a second setting value of the present invention). The setting value $\alpha'$ of the second switching valve 62 is higher than the setting value $\alpha$ of the first switching valve 52 (corresponding to a first setting value of the present invention).

When the second switching valve 62 is in the closed position, the second switching valve 62 blocks the pump line 61, and brings the supply/discharge line 63 into communication with the tank. When the second switching valve 62 is in the open position, the second switching valve 62 brings the pump line 61 into communication with the supply/discharge line 63. The pilot port of the second switching valve 62 is connected to the aforementioned first pilot line 5*c* by a switching pilot line 64.

Figure 7:
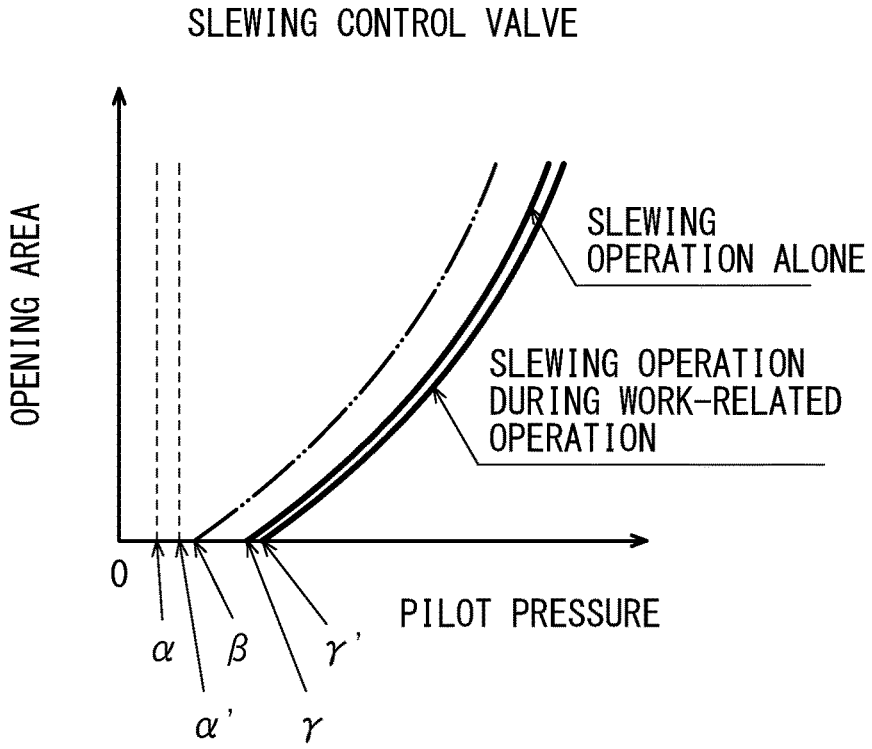
FIG. 7 is a graph showing a relationship between a pilot pressure to a slewing control valve and the opening area of the slewing control valve.
Figure 8:
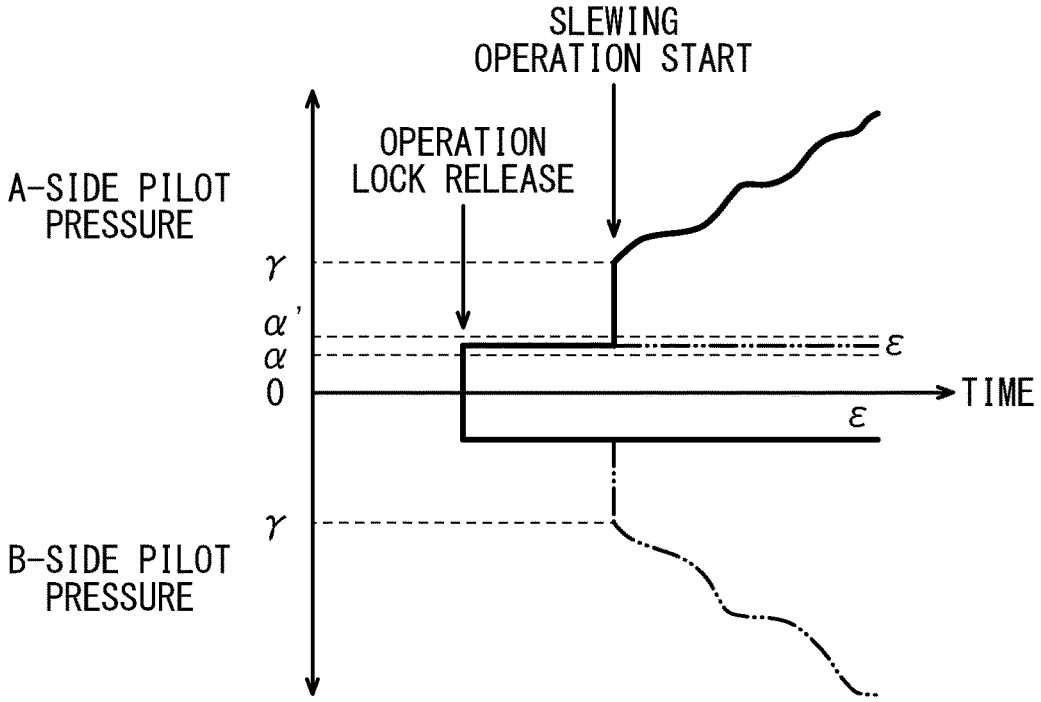
FIG. 8 is a graph showing temporal changes in pilot pressures outputted from the first solenoid proportional valve and the second solenoid proportional valve when a slewing operation is performed alone after an operation lock is released.
Figure 9:
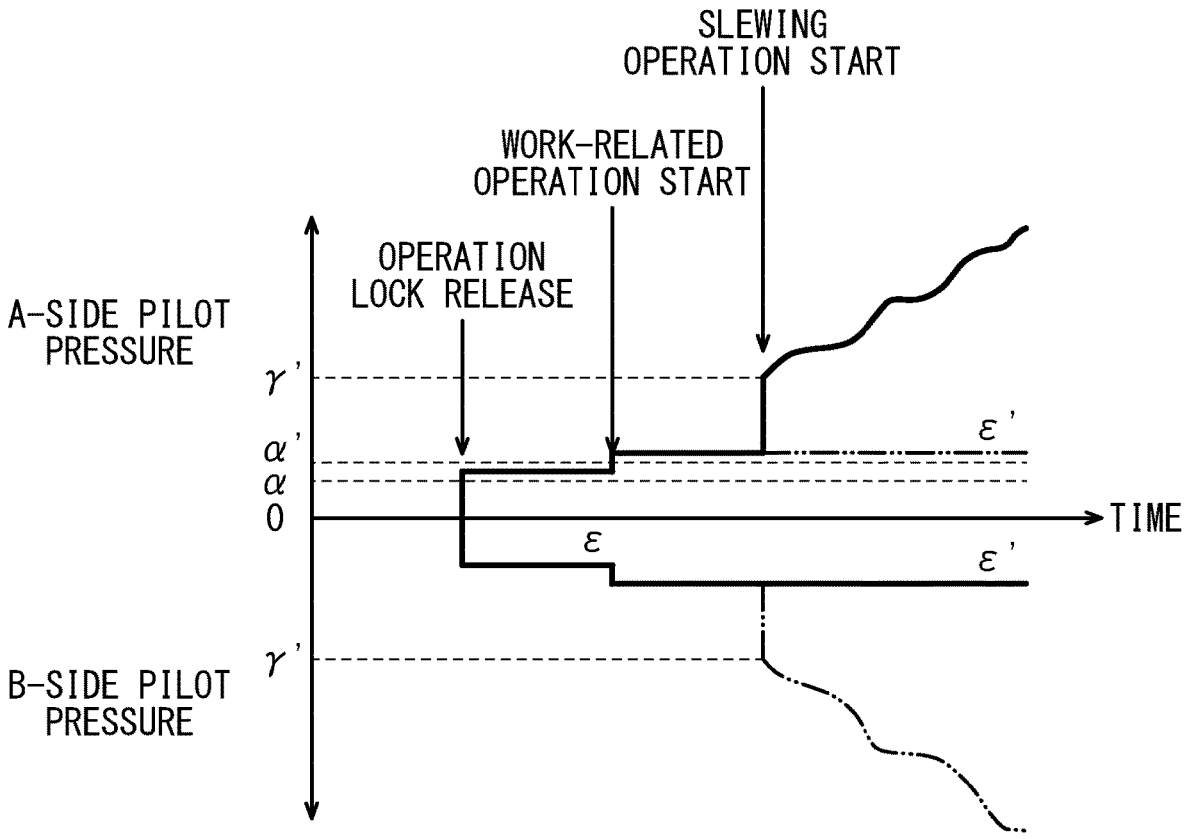
FIG. 9 is a graph showing temporal changes in pilot pressures outputted from the first solenoid proportional valve and the second solenoid proportional valve when a slewing operation is performed during a work-related operation being performed.

Next, with reference to FIGS. 7 to 9, the control of the first solenoid proportional valve 6*c* and the second solenoid proportional valve 6*d* by the controller 70 is described in detail. In FIGS. 7 to 9, the first pilot port side of the slewing control valve 4*t* is referred to as "A side" and the second pilot port side of the slewing control valve 4*t* is referred to as "B side."

While the selector 71 is receiving the selection of operation lock, the controller 70 controls the first solenoid proportional valve 6*c* and the second solenoid proportional valve 6*d*, such that the secondary pressure of each of the first solenoid proportional valve 6*c* and the second solenoid proportional valve 6*d* is lower than the setting value $\alpha$ of the first switching valve 52 as shown in FIG. 8. As a result, the first switching valve 52 is kept in the closed position. At the time, the controller 70 may feed no command current to the first solenoid proportional valve 6*c* and the second solenoid proportional valve 6*d*, or may feed a command current lower than the electric current value corresponding to the setting value $\alpha$ to each of the first solenoid proportional valve 6*c* and the second solenoid proportional valve 6*d*.

On the other hand, while the selector 71 is receiving the selection of operation lock release, the controller 70 controls the first solenoid proportional valve 6*c* and the second solenoid proportional valve 6*d*, such that the secondary pressure of each of the first solenoid proportional valve 6*c* and the second solenoid proportional valve 6*d* is higher than the setting value $\alpha$ of the first switching valve 52. As a result, the first switching valve 52 is switched to the open position, and thereby operations other than the slewing operations are also enabled.

To be more specific, during the selector 71 receiving the selection of operation lock release, when neither the first slewing operation nor the second slewing operation is performed (i.e., when neither the first slewing electrical signal nor the second slewing electrical signal is outputted from the slewing operation device 7*d*), the controller 70 feeds a standby current as a command current to each of the first solenoid proportional valve 6*c* and the second solenoid proportional valve 6*d* to keep the secondary pressure of each of the first solenoid proportional valve 6*c* and the second solenoid proportional valve 6*d* to the predetermined value $\varepsilon$, which is higher than the setting value $\alpha$ of the first switching valve 52. The predetermined value $\varepsilon$ is lower than the setting value $\alpha'$ of the second switching valve 62.

As shown in FIG. 7, in a case where the pilot pressure at one of the first and second pilot ports of the slewing control valve 4*t* is zero, when the pilot pressure at the other one of the first and second pilot ports becomes the predetermined value $\beta$, the slewing control valve 4*t* starts opening. The predetermined value $\beta$ is higher than the setting value $\alpha'$ of the second switching valve 62.

On the other hand, during the selector 71 receiving the selection of operation lock release, when the first slewing operation is performed (i.e., when the first slewing electrical signal is outputted from the slewing operation device 7*d*), at the start of the slewing operation, the controller 70 feeds a command current to the first solenoid proportional valve 6*c*, such that the secondary pressure of the first solenoid proportional valve 6*c* increases from the predetermined value ε to the predetermined value γ (=β+ε) as indicated by solid line in FIG. 8. Thereafter, the controller 70 feeds a command current whose magnitude corresponds to the first slewing electrical signal to the first solenoid proportional valve 6*c* as described in Embodiment 1. The secondary pressure of the second solenoid proportional valve 6*d* is kept to the predetermined value ε.

Similarly, during the selector 71 receiving the selection of operation lock release, when the second slewing operation is performed (i.e., when the second slewing electrical signal is outputted from the slewing operation device 7*d*), at the start of the slewing operation, the controller 70 feeds a command current to the second solenoid proportional valve 6*d*, such that the secondary pressure of the second solenoid proportional valve 6*d* increases from the predetermined value ε to the predetermined value γ (=β+ε) as indicated by two-dot chain line in FIG. 8. Thereafter, the controller 70 feeds a command current whose magnitude corresponds to the second slewing electrical signal to the second solenoid proportional valve 6*d* as described in Embodiment 1. The secondary pressure of the first solenoid proportional valve 6*c* is kept to the predetermined value ε.

That is, in the present embodiment, both when the first slewing operation is performed and when the second slewing operation is performed, the controller 70 controls the first solenoid proportional valve 6*c* and the second solenoid proportional valve 6*d*, such that each of the first solenoid proportional valve 6*c* and the second solenoid proportional valve 6*d* outputs a secondary pressure higher than or equal to the setting value α' of the second switching valve 62.

Further, in the present embodiment, also when a boom operation, an arm operation, or a bucket operation (hereinafter, each of these operations is referred to as a "work-related operation") is performed, the controller 70 controls the first solenoid proportional valve 6*c* and the second solenoid proportional valve 6*d*, such that each of the first solenoid proportional valve 6*c* and the second solenoid proportional valve 6*d* outputs a secondary pressure higher than or equal to the setting value α' of the second switching valve 62. Whether or not a boom operation is being performed is determined based on whether or not the boom operation device 7*a* is outputting a boom electrical signal. Whether or not an arm operation is being performed is determined based on whether or not the arm operation device 7*b* is outputting an arm electrical signal. Whether or not a bucket operation is being performed is determined based on whether or not the bucket operation device 7*c* is outputting a bucket electrical signal.

To be more specific, as shown in FIG. 9, at the start of a work-related operation, the controller 70 feeds a command current to each of the first solenoid proportional valve 6*c* and the second solenoid proportional valve 6*d*, such that the secondary pressure of each of the first solenoid proportional valve 6*c* and the second solenoid proportional valve 6*d* increases from the predetermined value ε to a predetermined value ε'. As a result, the second switching valve 62 switches to the open state, and the braking by the mechanical brake 83 is released. The secondary pressure of each of the first solenoid proportional valve 6*c* and the second solenoid proportional valve 6*d* is kept to the predetermined value ε' during the work-related operation being performed, and brought back to the predetermined value ε when the work-related operation is ended.

Therefore, when the first slewing operation is performed during the work-related operation being performed, as indicated by solid line in FIG. 9, at the start of the slewing operation, the secondary pressure of the first solenoid proportional valve 6*c* increases from the predetermined value ε' to a predetermined value γ' (=β+ε'). On the other hand, when the second slewing operation is performed during the work-related operation being performed, as indicated by two-dot chain line in FIG. 9, at the start of the slewing operation, the secondary pressure of the second solenoid proportional valve 6*d* increases from the predetermined value ε' to the predetermined value γ' (=β+ε').

As described above, in the hydraulic system 1B of the present embodiment, whether to switch the first switching valve 52, which is interposed between the auxiliary pump 23 and the solenoid proportional valves 6 except the first solenoid proportional valve 6*c* and the second solenoid proportional valve 6*d*, to the closed position or to the open position, i.e., whether to invalidate or validate operations performed on the operation devices 7 except the slewing operation device 7*d*, can be switched based on the secondary pressure of the first solenoid proportional valve 6*c*. That is, the first switching valve 52 can be operated by using the first solenoid proportional valve 6*c*, which is intended for driving the slewing control valve 4*t*. Therefore, a solenoid valve dedicated for invalidating operations performed on the operation devices 7 except the slewing operation device 7*d* is unnecessary.

Since the present embodiment includes the selector 71, when the operator makes the selection of operation lock with the selector 71, operations performed on the operation devices 7 except the slewing operation device 7*d* are invalidated, whereas when the operator makes the selection of operation lock release with the selector 71, operations performed on the operation devices 7 except the slewing operation device 7*d* are validated.

Further, in the present embodiment, when the first solenoid proportional valve 6*c* outputs a secondary pressure higher than or equal to the setting value α' of the second switching valve 62, the second switching valve 62 switches to the open state, and the braking by the mechanical brake 83 is released. That is, not only the first switching valve 52, but also the second switching valve 62 can be operated by using the first solenoid proportional valve 6*c*, which is intended for driving the slewing control valve 4*t*. This makes it possible to reduce the number of solenoid valves, by 2, as compared to a case where both the first switching valve 52 and the second switching valve 62 are solenoid on-off valves.

<Variations>

Similar to Embodiment 1, while the selector 71 is receiving the selection of operation lock release, the secondary pressure of the second solenoid proportional valve 6*d* may be zero. In this case, also when the first slewing operation is performed, the secondary pressure of the second solenoid proportional valve 6*d* may be zero.

When a work-related operation is performed, the secondary pressure of each of the first solenoid proportional valve 6*c* and the second solenoid proportional valve 6*d* may be kept to the predetermined value ε.

Embodiment 3

Figure 10:
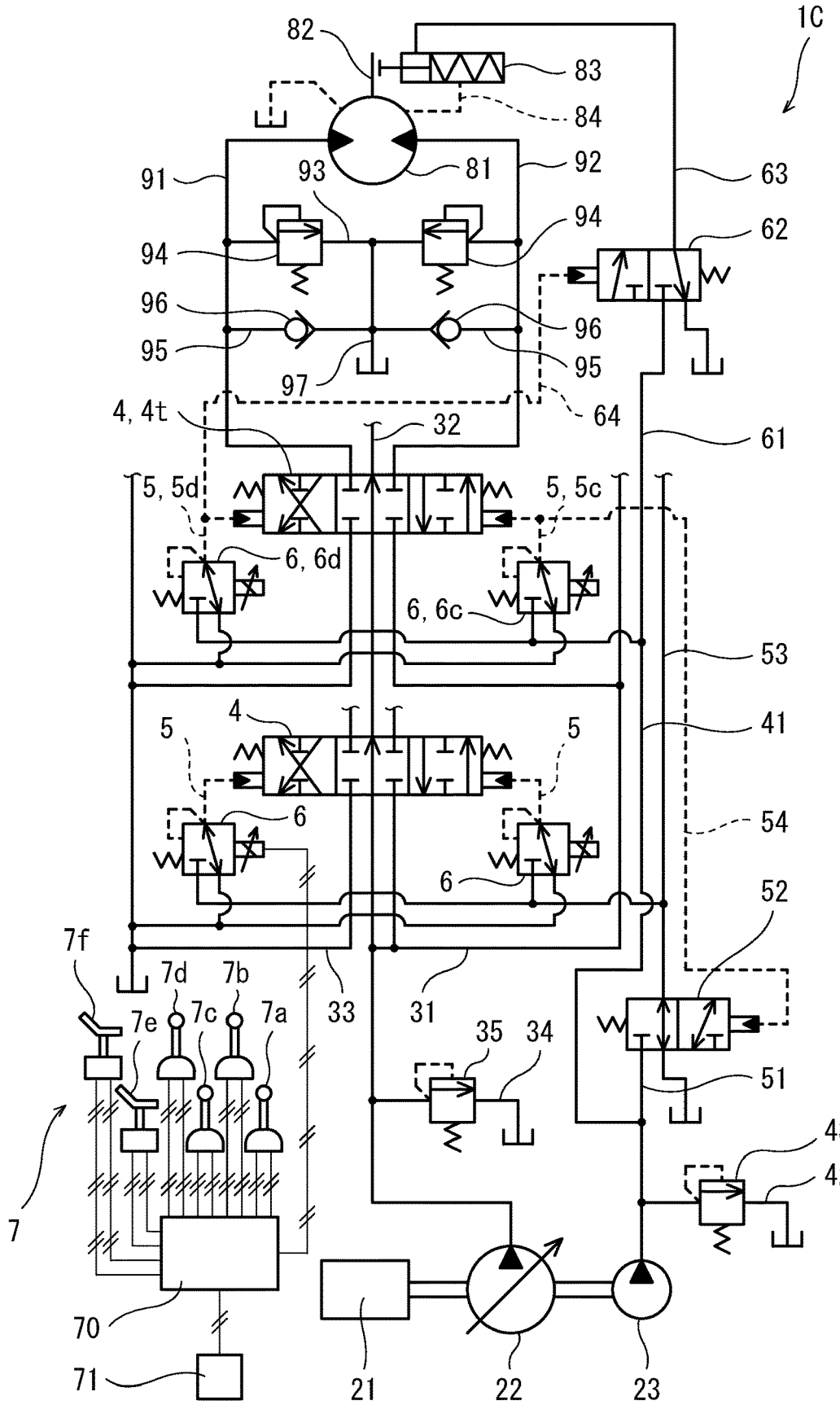
FIG. 10 shows a schematic configuration of a hydraulic system according to Embodiment 3 of the present invention.

FIG. 10 shows a hydraulic system 1C of a construction machine according to Embodiment 3 of the present invention. The only difference between the hydraulic system 1C of the present embodiment and the hydraulic system 1B of Embodiment 2 is that, in the hydraulic system 1C, the pilot port of the second switching valve 62 is connected not to the first pilot line 5*c*, but to the second pilot line 5*d* by the switching pilot line 64. The control of the first solenoid proportional valve 6*c* and the second solenoid proportional valve 6*d* is the same as the control performed in Embodiment 2.

Also with this configuration, similar to Embodiment 2, the first switching valve 52 can be operated by using the first solenoid proportional valve 6*c*, which is intended for driving the slewing control valve 4*t*.

Further, in the present embodiment, when the second solenoid proportional valve 6*d* outputs a secondary pressure higher than or equal to the setting value α' of the second switching valve 62, the second switching valve 62 switches to the open state, and the braking by the mechanical brake 83 is released. That is, the second switching valve 62 can be operated by using the second solenoid proportional valve 6*d*, which is intended for driving the slewing control valve 4*t*. Therefore, similar to Embodiment 2, the number of solenoid valves can be reduced, by 2, as compared to a case where both the first switching valve 52 and the second switching valve 62 are solenoid on-off valves.

<Variations>

Similar to Embodiment 1, while the selector 71 is receiving the selection of operation lock release, the secondary pressure of the second solenoid proportional valve 6*d* may be zero.

Other Embodiments

The present invention is not limited to the above-described embodiments. Various modifications can be made without departing from the scope of the present invention.

For example, in a case where the solenoid proportional valves 6 are inverse proportional valves, the switching valve 52 may switch from the open position to the closed position when the pilot pressure becomes higher than or equal to a relatively high setting value.

(Summary)

As described above, a hydraulic system of a construction machine according to the present invention includes: control valves interposed between a main pump and hydraulic actuators, each control valve including a pair of pilot ports; solenoid proportional valves connected to the pair of pilot ports of the control valves; operation devices to move the control valves, each operation device outputting an electrical signal corresponding to an operating amount of the operation device; and a controller that controls the solenoid proportional valves based on the electrical signals outputted from the operation devices. The control valves include a particular control valve, and the solenoid proportional valves include a first solenoid proportional valve and a second solenoid proportional valve that are connected to the pair of pilot ports of the particular control valve by a first pilot line and a second pilot line, respectively. The first solenoid proportional valve and the second solenoid proportional valve are directly connected to an auxiliary pump. The solenoid proportional valves except the first solenoid proportional valve and the second solenoid proportional valve are connected to the auxiliary pump via a switching valve. The switching valve includes a pilot port that is connected to the first pilot line by a switching pilot line, and switches between a closed position and an open position in accordance with a pilot pressure led to the pilot port of the switching valve.

According to the above configuration, whether to switch the switching valve, which is interposed between the auxiliary pump and the solenoid proportional valves except the first solenoid proportional valve and the second solenoid proportional valve, to the closed position or to the open position, i.e., whether to invalidate or validate operations performed on the operation devices except a particular operation device that is an operation device to move the particular control valve, can be switched based on the secondary pressure of the first solenoid proportional valve. That is, the switching valve can be operated by using the first solenoid proportional valve, which is intended for driving the particular control valve. Therefore, a solenoid valve dedicated for invalidating operations performed on the operation devices except the particular operation device is unnecessary.

For example, each of the solenoid proportional valves may be a direct proportional valve that outputs a secondary pressure indicating a positive correlation with a command current, and the switching valve may switch from the closed position to the open position when the pilot pressure led to the pilot port of the switching valve becomes higher than or equal to a setting value.

The operation devices may include a particular operation device to move the particular control valve. The hydraulic system may further include a selector that receives a selection of operation lock, which is a selection to invalidate operations performed on the operation devices except the particular operation device, and a selection of operation lock release, which is a selection to validate operations performed on the operation devices except the particular operation device. While the selector is receiving the selection of operation lock, the controller may control the first solenoid proportional valve, such that the secondary pressure of the first solenoid proportional valve is lower than the setting value. While the selector is receiving the selection of operation lock release, the controller may control the first solenoid proportional valve, such that the secondary pressure of the first solenoid proportional valve is higher than the setting value. According to this configuration, when an operator makes the selection of operation lock with the selector, operations performed on the operation devices except the particular operation device are invalidated, whereas when the operator makes the selection of operation lock release with the selector, operations performed on the operation devices except the particular operation device are validated.

While the selector is receiving the selection of operation lock, the controller may control the second solenoid proportional valve, such that the secondary pressure of the second solenoid proportional valve is lower than the setting value, and while the selector is receiving the selection of operation lock release, the controller may control the second solenoid proportional valve, such that the secondary pressure of the second solenoid proportional valve is higher than the setting value. While the selector is receiving the selection of operation lock, the secondary pressure of the second solenoid proportional valve may be zero. In this case, however, the pressure difference between the pilot pressure for switching the switching valve and the pilot pressure when the particular control valve starts opening is small. Therefore, it is desirable to take malfunction preventative measures, such as strengthening a return spring in the particular control valve. In this respect, while the selector is receiving the selection of operation lock, if the second solenoid proportional valve also outputs a secondary pressure higher than or equal to the setting value of the switching valve, the pressure difference between the pilot pressure for switching the switching valve and the pilot pressure when the particular control valve starts opening becomes great. Therefore, taking malfunction preventative measures is unnecessary.

For example, the construction machine may be a hydraulic excavator, and the particular control valve may be a bucket control valve.

Alternatively, the particular control valve may be a slewing control valve.

In a case where the particular control valve is a slewing control valve, the construction machine may be a self-propelled hydraulic excavator. The switching valve may be a first switching valve, and the setting value may be a first setting value. The hydraulic system may further include: a slewing motor that is connected to the slewing control valve by a pair of supply/discharge lines; a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft; and a second switching valve interposed between the auxiliary pump and the mechanical brake, the second switching valve including a pilot port that is connected to the first pilot line by a switching pilot line, the second switching valve switching from a closed position to an open position when a pilot pressure led to the pilot port of the second switching valve becomes higher than or equal to a second setting value. The second setting value may be higher than the first setting value. According to this configuration, when the first solenoid proportional valve outputs a secondary pressure higher than or equal to the setting value of the second switching valve, the second switching valve switches to the open state, and the braking by the mechanical brake is released. That is, not only the first switching valve, but also the second switching valve can be operated by using the first solenoid proportional valve, which is intended for driving the slewing control valve. This makes it possible to reduce the number of solenoid valves, by 2, as compared to a case where both the first switching valve and the second switching valve are solenoid on-off valves.

For example, the operation devices may include a slewing operation device that receives a first slewing operation and a second slewing operation. The pair of pilot ports of the slewing control valve may be a first pilot port for the first slewing operation and a second pilot port for the second slewing operation. Both when the first slewing operation is performed and when the second slewing operation is performed, the controller may control the first solenoid proportional valve, such that the first solenoid proportional valve outputs a secondary pressure higher than or equal to the second setting value.

Alternatively, both when the first slewing operation is performed and when the second slewing operation is performed, the controller may control the first solenoid proportional valve and the second solenoid proportional valve, such that each of the first solenoid proportional valve and the second solenoid proportional valve outputs a secondary pressure higher than or equal to the second setting value.

The construction machine may be a self-propelled hydraulic excavator. The switching valve may be a first switching valve, and the setting value may be a first setting value. The hydraulic system may further include: a slewing motor that is connected to the slewing control valve by a pair of supply/discharge lines; a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft; and a second switching valve interposed between the auxiliary pump and the mechanical brake, the second switching valve including a pilot port that is connected to the second pilot line by a switching pilot line, the second switching valve switching from a closed position to an open position when a pilot pressure led to the pilot port of the second switching valve becomes higher than or equal to a second setting value. The second setting value may be higher than the first setting value. According to this configuration, when the second solenoid proportional valve outputs a secondary pressure higher than or equal to the setting value of the second switching valve, the second switching valve switches to the open state, and the braking by the mechanical brake is released. That is, the second switching valve can be operated by using the second solenoid proportional valve, which is intended for driving the slewing control valve. This makes it possible to reduce the number of solenoid valves, by 2, as compared to a case where both the first switching valve and the second switching valve are solenoid on-off valves.

For example, the operation devices may include a slewing operation device that receives a first slewing operation and a second slewing operation. The pair of pilot ports of the slewing control valve may be a first pilot port for the first slewing operation and a second pilot port for the second slewing operation. Both when the first slewing operation is performed and when the second slewing operation is performed, the controller may control the first solenoid proportional valve and the second solenoid proportional valve, such that each of the first solenoid proportional valve and the second solenoid proportional valve outputs a secondary pressure higher than or equal to the second setting value.

The invention claimed is:

1. A hydraulic system of a construction machine, comprising:

control valves interposed between a main pump and hydraulic actuators, each control valve including a pair of pilot ports;

solenoid proportional valves connected to the pair of pilot ports of the control valves;

operation devices to move the control valves, each operation device outputting an electrical signal corresponding to an operating amount of the operation device; and a controller that controls the solenoid proportional valves based on the electrical signals outputted from the operation devices, wherein the control valves include a particular control valve, and the solenoid proportional valves include a first solenoid proportional valve and a second solenoid proportional valve that are connected to the pair of pilot ports of the particular control valve by a first pilot line and a second pilot line, respectively, the first solenoid proportional valve and the second solenoid proportional valve are directly connected to an auxiliary pump, the solenoid proportional valves except the first solenoid proportional valve and the second solenoid proportional valve are connected to the auxiliary pump via a switching valve, and the switching valve includes a pilot port that is connected to the first pilot line by a switching pilot line, and switches between a closed position and an open position in accordance with a pilot pressure led to the pilot port of the switching valve.

2. The hydraulic system of a construction machine according to claim 1, wherein each of the solenoid proportional valves is a direct proportional valve that outputs a secondary pressure indicating a positive correlation with a command current, and the switching valve switches from the closed position to the open position when the pilot pressure led to the pilot port of the switching valve becomes higher than or equal to a setting value.

3. The hydraulic system of a construction machine according to claim 2, wherein the operation devices include a particular operation device to move the particular control valve, and the hydraulic system further comprises a selector that receives a selection of operation lock, which is a selection to invalidate operations performed on the operation devices except the particular operation device, and a selection of operation lock release, which is a selection to validate operations performed on the operation devices except the particular operation device, wherein while the selector is receiving the selection of operation lock, the controller controls the first solenoid proportional valve, such that the secondary pressure of the first solenoid proportional valve is lower than the setting value, and while the selector is receiving the selection of operation lock release, the controller controls the first solenoid proportional valve, such that the secondary pressure of the first solenoid proportional valve is higher than the setting value.

4. The hydraulic system of a construction machine according to claim 3, wherein while the selector is receiving the selection of operation lock, the controller controls the second solenoid proportional valve, such that the secondary pressure of the second solenoid proportional valve is lower than the setting value, and while the selector is receiving the selection of operation lock release, the controller controls the second solenoid proportional valve, such that the secondary pressure of the second solenoid proportional valve is higher than the setting value.

5. The hydraulic system of a construction machine according to claim 1, wherein the construction machine is a hydraulic excavator, and the particular control valve is a bucket control valve.

6. The hydraulic system of a construction machine according to claim 1, wherein the particular control valve is a slewing control valve.

7. The hydraulic system of a construction machine according to claim 6, wherein the construction machine is a self-propelled hydraulic excavator, the switching valve is a first switching valve, and the setting value is a first setting value, the hydraulic system further comprises:

a slewing motor that is connected to the slewing control valve by a pair of supply/discharge lines;

a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft; and a second switching valve interposed between the auxiliary pump and the mechanical brake, the second switching valve including a pilot port that is connected to the first pilot line by a switching pilot line, the second switching valve switching from a closed position to an open position when a pilot pressure led to the pilot port of the second switching valve becomes higher than or equal to a second setting value, and the second setting value is higher than the first setting value.

8. The hydraulic system of a construction machine according to claim 7, wherein the operation devices include a slewing operation device that receives a first slewing operation and a second slewing operation, the pair of pilot ports of the slewing control valve are a first pilot port for the first slewing operation, and a second pilot port for the second slewing operation, and both when the first slewing operation is performed and when the second slewing operation is performed, the controller controls the first solenoid proportional valve, such that the first solenoid proportional valve outputs a secondary pressure higher than or equal to the second setting value.

9. The hydraulic system of a construction machine according to claim 8, wherein both when the first slewing operation is performed and when the second slewing operation is performed, the controller controls the first solenoid proportional valve and the second solenoid proportional valve, such that each of the first solenoid proportional valve and the second solenoid proportional valve outputs a secondary pressure higher than or equal to the second setting value.

10. The hydraulic system of a construction machine according to claim 6, wherein the construction machine is a self-propelled hydraulic excavator, the switching valve is a first switching valve, and the setting value is a first setting value, the hydraulic system further comprises:

a slewing motor that is connected to the slewing control valve by a pair of supply/discharge lines;

a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft; and a second switching valve interposed between the auxiliary pump and the mechanical brake, the second switching valve including a pilot port that is connected to the second pilot line by a switching pilot line, the second switching valve switching from a closed position to an open position when a pilot pressure led to the pilot port of the second switching valve becomes higher than or equal to a second setting value, and the second setting value is higher than the first setting value.

11. The hydraulic system of a construction machine according to claim 10, wherein the operation devices include a slewing operation device that receives a first slewing operation and a second slewing operation, the pair of pilot ports of slewing control valve are a first pilot port for the first slewing operation, and a second pilot port for the second slewing operation, and both when the first slewing operation is performed and when the second slewing operation is performed, the controller controls the first solenoid proportional valve and the second solenoid proportional valve, such that each of the first solenoid proportional valve and the second solenoid proportional valve outputs a secondary pressure higher than or equal to the second setting value.

* * * * *